United States Patent [19]

Patry

[11] 3,984,947

[45] Oct. 12, 1976

[54] ROOF STRUCTURE INCLUDING A ONE-WAY VAPOR VENT

[75] Inventor: Francis Joseph Patry, Lewiston, Maine

[73] Assignee: Johns-Manville Corporation, Denver, Colo.

[22] Filed: July 31, 1975

[21] Appl. No.: 600,685

[52] U.S. Cl. ..... 52/1; 52/199; 52/302

[51] Int. Cl.[2] ..... E04B 7/00

[58] Field of Search ..... 52/302, 199, 303, 305, 52/209, 1; 98/119, 118

[56] References Cited

UNITED STATES PATENTS

| | | | |
|---|---|---|---|
| 3,466,819 | 9/1969 | Giger | 52/303 X |
| 3,593,478 | 7/1971 | Mason | 52/302 |
| 3,598,688 | 8/1971 | Bellamy | 52/302 X |

*Primary Examiner*—Price C. Faw, Jr.
*Assistant Examiner*—Carl D. Friedman
*Attorney, Agent, or Firm*—Robert M. Krone; Joseph J. Kelly; Stephen C. Shear

[57] ABSTRACT

An overall roof arrangement is disclosed herein and includes a roof structure comprised of a roof deck, roof insulation disposed over the deck and a built-up roof disposed over the insulation. This overall arrangement also includes a one-way vent through which moisture within the roof structure and subsequently converted to vapor passes to the ambient surroundings. However, this vent prevents moisture vapor in the ambient surroundings from being drawn back into the roof structure through the vent.

5 Claims, 3 Drawing Figures

ROOF STRUCTURE INCLUDING A ONE-WAY VAPOR VENT

BACKGROUND OF THE INVENTION

The present invention relates generally to roof structures including moisture vapor vents and more particularly to a roof structure in combination with a one-way moisture vapor vent.

A typical roof structure to which the present invention relates includes a roof deck, roof insulation disposed over the deck and the built-up roof disposed over the insulation. It has long been recognized that this type of structure includes residual moisture within, particularly at the time it is assembled together. This is particularly true where the deck is constructed of wood and the insulation is standard perlite-type board. Even a "cured" wooden deck includes a certain amount of residual moisture which escapes only with time and the application of ambient heat. This is equally true of standard perlite board which typically includes as much as 7 percent moisture at the time it is manufactured. There is also a tendency for moisture to be captured between the various layers of the roof structure, i.e., between the roof deck and insulation and between the insulation and built-up roof. This results generally from the fact that these three components are assembled together in the field, quite often over a relatively long period of time. Hence, they are exposed to ambient moisture, even rain, which not only penetrates into the components but also collects therebetween.

The roof structure once assembled is subjected to the ambient surroundings and, as is well known, can become very hot, particularly where the roof structure is located in warm to hot climates. As a result, the moisture within the structure has a tendency to heat up and convert to vapor in a pressurized state greater than that of the ambient surroundings. It has long been recognized that this pressurized vapor is one main cause of blistering in the built-up roof and that this blistering problem can be reduced by providing positive venting points for the passage of the moisture vapor to the ambient surrounds. Accordingly, most roof structures of the type described above include conventional open ended vents located at various points along the structure.

These vents, i.e., open ended tubes, just described are prefectly satisfactory for venting moisture from within the roof structure, i.e., within the roof deck, insulation and built-up roof and therebetween to the ambient surroundings. However, Applicant has discovered that the venting of this moisture to the ambient surroundings results in voids within the roof structure and specifically, that these voids produce sufficient back pressure to "draw" moisture from the ambient surroundings back into the roof structure through the tubular vents. Generally, Applicant has found that while moisture vapor which builds up within the roof structure during the heat of the day passes out through the vents, during the night, under much cooler conditions, moisture within the ambient surroundings is drawn back into the structure through the vents. It is not necessarily true that this entire intake of moisture during the cooler period is completely vented back into the ambient surroundings the next day. Rather, it is quite possible that some of this moisture never escapes but rather aids in the blistering problem discussed above.

As will be seen hereinafter, the present invention is directed to minimizing if not eliminating this drawback in standard venting practice by combining a one-way vent with a roof structure of the type described above. In this regard, Applicant has found that the pressure buildup within the roof structure resulting from the moisture vapor therein is sufficiently high before actual passage of the moisture and that the pressure within the roof structure after passage of the moisture vapor is sufficiently low to operate a one-way vent, i.e., to allow escape of the moisture vapor to the ambient surroundings but to prevent moisture vapor from being drawn back into the roof structure through the vent.

SUMMARY OF THE INVENTION

An object of the present invention is to provide a roof structure comprised of a roof deck, roof insulation and a built-up roof in combination with improved means for venting gas and for example moisture vapor to the ambient surroundings from within the roof structure.

Another object of the present invention is to provide a roof structure comprised of a roof deck, roof insulation, and a built-up roof in combination with a vent for providing passage of the moisture vapor to the ambient surroundings but preventing moisture vapor within the ambient surroundings from being drawn back into the roof structure through the vent.

Still another object of the present invention is to provide a specific one-way vent in combination with a roof structure of the type just described.

An overall roof arrangement including a roof structure and tubular vent is disclosed herein. The roof structure itself includes a roof deck, roof insulation disposed over the deck and a built-up roof disposed over the insulation. The tubular vent has an opened entry end positioned against the roof structure, specifically around an opening in the built-up roof and an exit end spaced from the roof structure, whereby to allow gas and, for example, moisture vapor from the structure to pass into the vent through the entry end and thereafter to the ambient surroundings through the exit end.

In accordance with the present invention, the tubular vent includes means connected across its exit end for (1) opening the vent to the ambient surroundings through the exit end when the pressure within the vent is greater than the pressure outside the exit end and (2) closing the exit end when the pressure within the vent is less than the pressure outside the exit end. In this way, when gas generally and moisture vapor in particular from the roof structure builds up pressure within the vent it is passed through the exit end in the vent, i.e., through the means connected across the exit end. However, should the passage of this moisture create a low pressure condition within the vent, that is, a lower pressure than that of the ambient surroundings, the means connected across the vent will prevent gas and particularly moisture from being drawn back into the vent.

In a preferred embodiment of the present invention, an outer flexible diaphragm is connected across the exit end of the vent and movable between a first position when the pressure within the vent is greater than the pressure outside the exit end and a second position when the pressure within the vent is less than that outside the exit end. This diaphragm includes at least one passage which opens the vent to the ambient surroundings when the diaphragm is in its first position, i.e., when the pressure within the vent is greater than that of the ambient surrounds. A second diaphragm, specifically a sealing diaphragm is also connected across the exit end adjacent to and inside the first diaphragm. The sealing diaphragm, which closes the passage through the outer diaphragm when the latter is in its second position, also includes a passage extending therethrough, this latter passage being offset with respect to the passage or passages through the first or outer diaphragm.

These two diaphragms cooperate with one another and with a rigid circumferential flange connected with the vent itself across the exit end of the latter and inside the sealing flange. When pressure builds up within the vent due for example to moisture vapor therein, a sufficient pressure differential is produced across the outer diaphragm through the openings in the sealing diaphram and inner flange and in the direction of the ambient surroundings to force a portion of the outer diaphragm out and away from the sealing diaphragm. This movement opens the opening or openings through the outer diaphragm for passage of the moisture vapor therethrough and into the ambient surroundings. Once this moisture escapes, should the voids left in the roof structure produce a reverse pressure differential, the outer diaphragm is drawn tightly against the sealing diaphragm by the reverse pressure differential so as to close the opening or openings in the outer diaphragm to prevent moisture from being drawn back into the vent.

DETAILED DESCRIPTION

Figure 1:
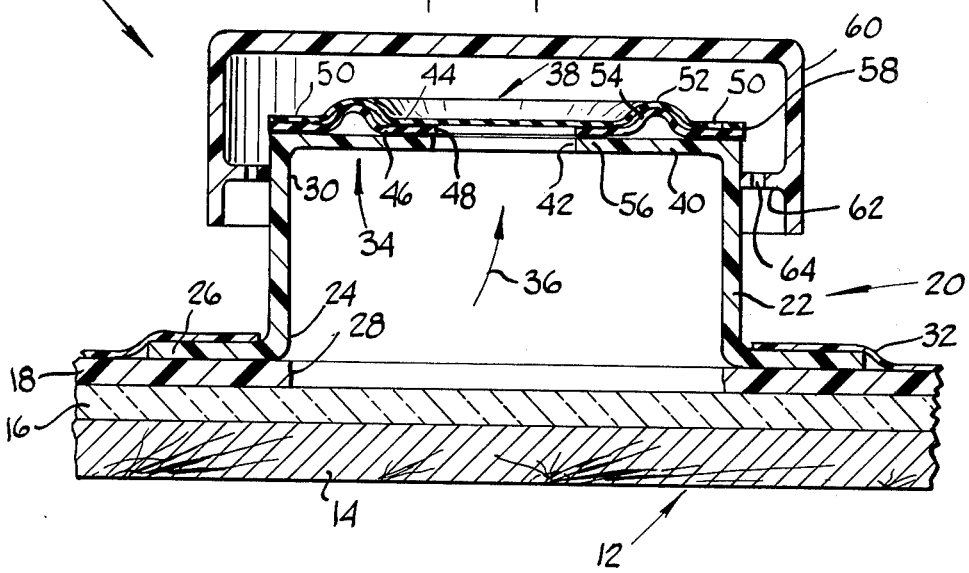
FIG. 1 is a vertical sectional view of a roof arrangement including a roof structure in combination with a tubular vent constructed in accordance with the present invention.

Turning to the drawing, wherein like components are designated by like reference numerals throughout the three figures, attention is specifically directed to FIG. 1 which illustrates an overall arrangement constructed in accordance with the present invention and designated by the reference numeral 10. This arrangement includes a standard built-up roof structure 12 which itself includes a roof deck 14, roof insulation 16 disposed over the deck and a conventional built-up roof 18 disposed over the insulation. These three components making up the roof structure are themselves conventional and well known in the art. The roof deck may be either metal or wood. The insulation may be for example perlite type insulation board such as that sold by Johns-Manville Corporation under the trademark "FESCO" board and the built-up roof may be comprised of several layers of asphalt saturated felt, a roof membrane and an outer protective layer of granules. It is to be understood however that the prevent invention is not directed to this roof structure per se but rather to the roof structure of this general type which may or may not include other components in addition to and/or in lieu of some of the components just recited.

In accordance with the present invention, overall roof arrangement 10 also includes one or more one-way vents 20 in combination with roof structure 12. Only one such vent is illustrated in FIG. 1 and only this vent will be described. As seen in this figure, vent 20 includes a rigid tubular body 22 constructed of, for example, plastic or metal and having a bottom opened entry end 24 which is outwardly flanged at 26. Entry end 24 extends around an opening 28 in built-up roof 18 so that a top surface portion of roof insulation 16 is exposed. Flange 26 rests against the top surface of built-up roof 18 circumscribing opening 28 and body 22 of the vent extends upwardly therefrom so that the top exit end of the tubular body, indicated at 30, is spaced vertically above the overall roof structure.

Vent body 22 is preferably held in place against built-up roof 18 and around opening 28 by means of the asphalt comprising part of the built-up roof and located directly under flange 26 and by means of a separate flashing membrane 32. As illustrated in FIG. 1, membrane 32 is located over the top surface of flange 26 and extends down onto a portion of the built-up roof surrounding the flange. This membrane preferably extends completely around tubular body 22 and flange 26 and is adhered to the flange. In this way, the flashing membrane and asphalt adhesive between the flange and built-up roof, provide a reliable moisture seal between the vent and outer surface of the built-up roof. In this regard, it is to be understood that other suitable means, for example, other types of adhesive, could be provided for holding vent body 22 in place and for providing a suitable moisture seal between the vent body and built-up roof.

In accordance with the present invention, vent 20 includes an arrangement 34 which is connected across what would be the exit opening of vent body 22 at the exit end 30 of the vent body. As will be seen hereinafter, this arrangement 34 is provided for opening the vent to the ambient surroundings in the direction of arrow 36 illustrated in FIG. 1 when the pressure within the vent is greater than that of the ambient surroundings. As will also be seen, this arrangement closes the vent, actually the exit end into the vent, in the direction of arrow 38 when the pressure within the vent is less than the pressure outside the exit end.

Arrangement 34 includes a rigid circumferential flange 40 extending across exit end 30 of vent body 22. This flange, which may be an integral part of the vent body, includes a central opening or passage 42 extending therethrough. Arrangement 34 also includes an outer flexible diaphragm 44 constructed of for example silicone or other suitable elastomers and extending entirely across the exit end of tubular body 22 above flange 40. A sealing diaphragm 46 also constructed of for example silicone or other suitable elastomers and also comprising part or arrangement 34 is disposed between outer diaphragm 44 and flange 40 and extends across and over the latter.

As illustrated in FIG. 1, intermediate sealing diaphragm 46 includes a central opening or passage 48 extending therethrough and vertically aligned in communication with opening 42 through flange 40. On the other hand, outer diaphragm 44 includes at least one but preferably a plurality of openings or passages 50 which extend therethrough but which are laterally outwardly offset with respect to openings 42 and 48. Diaphragm 44 includes a circumferential raised section 52 which is located laterally inwardly of openings 50 and define what can be referred to as a circumferential channel in its underside. Diaphragm 46 also includes a circumferential raised section, indicated at 54, which is located laterally outside opening 48 and which is in vertical alignment with raised section 52. As illustrated in FIG. 1, raised section 54 sets within the channel defined by raised section 52 when the two diaphragms are in a relaxed state.

Diaphragm 46 is fixedly adherred to the outer surface of a flange 40 adjacent to and circumferentially around openings 42 and 48 but laterally inwardly of raised section 54. Any suitable adhesive, generally indicated at 56, may be used for this purpose. On the other hand, diaphragm 44 is fixedly adherred to diaphragm 46 around and between the outer peripheries of the two diaphragms, laterally outwardly out of openings 50 and raised sections 52 and 54 of the diaphragms. Any suitable adhesive, generally indicated at 58, may be provided for this purpose.

In addition to the foregoing, vent 20 may include a cover 60 which is located over and spaced from exit end 30 of vent body 22 and arrangement 34, as illustrated in FIG. 1. Cover 60 includes suitable means, for example a circumferential support flange 62 located around and against vent body 22, for holding the cover in place. The vent cover also includes a number of opened vent passages, for example, passages 64 extending therethrough. These passages are preferably positioned through the underside of the cover, for example through support flange 62, for preventing rain water or the like from passing therein.

Figure 2:
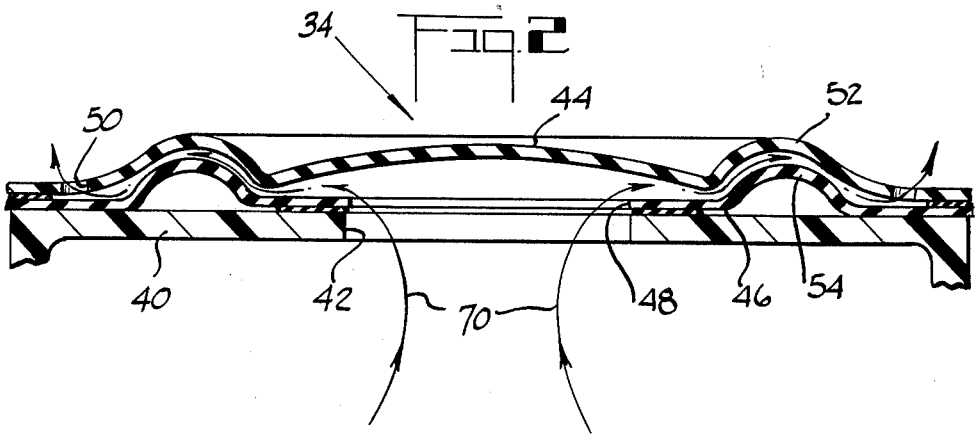
FIG. 2 is a vertical sectional view of a portion of the vent illustrated in FIG. 1, specifically illustrating how gasses and for example moisture vapor under pressure escape through the vent to the ambient surroundings.
Figure 3:
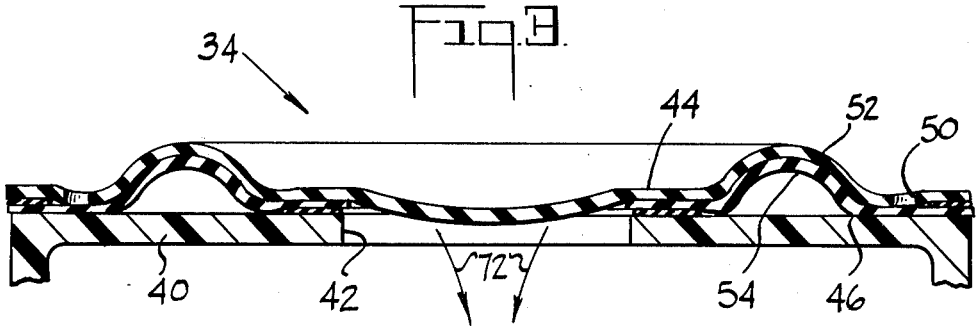
FIG. 3 is a vertical sectional view of a portion of the vent illustrated in FIG. 1, specifically illustrating how the vent prevents gasses and for example moisture from passing back therein from the ambient surroundings.

Having described vent 20 and particularly arrangement 34, attention is now directed to the manner in which this arrangement provides one-way vent action for venting moisture vapor from within the vent to the ambient surroundings but for preventing moisture from being drawn back into the vent. FIG. 2 illustrates how arrangement 34 passes moisture within the vent to the ambient surroundings and FIG. 3 illustrates how the arrangement prevents moisture in the ambient surroundings from being drawn back into the vent.

In the event the pressure within vent body 22 rises above ambient pressure, i.e., the pressure directly outside diaphragm 44, this results in a pressure differential across diaphragm 44 through openings 42 and 48 in the direction of arrow 36 illustrated in FIG. 1. As illustrated in FIG. 2, this pressure differential deforms that portion of diaphragm 44 not connected with sealing diaphragm 46 outwardly and away from the sealing diaphragm. This outward deformation opens a passage between the two diaphragms and through openings 50 in diaphragm 44 so that any gas and particularly moisture vapor within the vent body can pass therethrough and into the ambient surrounds, as indicated by arrows 70 in FIG. 2.

In the event that the pressure within vent body 22 is less than the pressure outside the vent body, that is, directly outside diaphragm 44, a pressure differential results across diaphragm 44 in the direction of arrow 38 in FIG. 1. As illustrated in FIG. 3, this reverse pressure differential draws the outer diaphragm 44 tightly against intermediate sealing diaphragm 46 as indicated by arrows 72 in FIG. 3 and if sufficiently high causes a portion of the outer diaphragm to deform into the openings 42 and 48. In any event, the outer diaphragm rests tightly against the intermediate sealing diaphragm to close any passage between the two diaphragms and particularly to close opening 50 in the outer diaphragm. Hence, any gases and particularly moisture or moisture vapor in the ambient surroundings is prevented from entering into vent body 22 through arrangement 34.

In actual practice, vent 20 constructed in accordance with the present invention has been found to quite satisfactorily vent moisture vapor from roof structure 12 and yet prevent moisture vapor from the ambient surroundings from being drawn back into the structure through the vent. Applicant found that this moisture vapor captured within the vent from the roof structure as a result of the latter being subjected to a relatively hot ambient surroundings is sufficient to deform outwardly diaphragm 44 in the manner described for providing escape of the vapor into the ambient surroundings. Applicant has also found that once the vapor escapes and after the roof structure cools down, a reverse pressure results which is sufficient to draw diaphragm tightly against sealing diaphragm 46.

The amount of pressure required to deform diaphragm 44 outwardly or to draw it tightly in depends on a number of factors including the cross-sectional area of diaphragm 44, the material making up outer diaphragm 44 and the thickness of the outer diaphragm. In an actual working embodiment of the present invention, diaphragm 44 is constructed of silicone and has a thickness of approximately 0.018 inch. This diaphragm has a durometer hardness of 30–40 Shore A and is capable of deforming out from sealing diaphragm 46 under a pressure differential as small as 0.004 psi for allowing the escape of moisture vapor within the body and is drawn in tightly against the sealing diaphragm under a reverse pressure differential as small as 0.004 psi. It has also been found that pressure differentials of these magnitudes are actually produced as a result of the roof structure heating up and subsequently cooling down.

It is to be understood that the present invention is not limited to the particular material making up diaphragms 44 and 46, the particular thickenss of diaphragm 44 or the size of the openings in the diaphragms and flange 40. In fact, while diaphragms 44 and 46 and flange 40 together comprise a preferred, working embodiment of arrangement 34, it is to be understood that this arrangement could be modified so long as it functions in the manner described. For example, if flange 40 is constructed of a material which can readily seal engage against diaphragm 44, it is possible to eliminate sealing diaphragm 46.

What I claim is:

1. A roof arrangement including a roof structure comprised of a roof deck, roof insulation disposed over said deck and a built-up roof disposed over said insulation, said arrangement further including a tubular vent having an opened entry end positioned against said roof structure and an exit end spaced from said structure whereby to allow gas and vapor within said roof structure to pass into said vent through said entry end and thereafter to the ambient surrounding through said exit end, the improvement comprising:

a. an outer flexible diaphragm connected across the exit and of said vent and movable between i. a first position when the pressure within said vent is greater than the pressure outside said exit end, and ii. a second position when the pressure within said vent is less than the pressure outside said exit end;

b. said diaphragm including at least one passage extending therethrough said passage being opened when said diaphragm is in said first position whereby to allow gas within said vent to pass therethrough to the ambient surrounding; and c. means for closing said diaphragm passage when said diaphragm is in said second position, whereby to prevent gas from passing therethrough into said vent from the ambient surrounding.

2. The improvement according to claim 1 wherein said closing means includes a. a sealing diaphragm connected across said exit end adjacent to and inside said outer diaphragm, said sealing diaphragm including a passage extending therethrough said last-mentioned passage being offset laterally inwardly with respect to any passage through said outer diaphragm.

3. The improvement according to claim 2 wherein said closing means further includes a rigid flange connected with said vent and extending across said exit end adjacent to and inside said sealing diaphragm, said flange including a passage extending therethrough said flange passage being in alignment with said sealing diaphragm passage.

4. The improvement according to claim 3 wherein:

a. said outer diaphragm is seal connected around its entire periphery to said sealing diaphragm laterally outwardly of any passage through said outer diaphragm, and:

b. said sealing diaphragm is seal connected to said flange around the entire periphery of its passage and the passage through said flange and laterally inwardly of any openings through said outer diaphragm.

5. The improvement according to claim 4 wherein:

a. said sealing diaphragm includes an outwardly protruding raised section on its outer surface and circumscribing the passage through said sealing diaphragm, said raised section being located laterally inside the opening in said outer diaphragm and laterally outside the seal between the said sealing diaphragm and said flange; and b. said outer diaphragm includes an outwardly protruding raised section on its outer surface which defines a channeled section in its inner surface, said channeled section extending around and directly over said raised section on said sealing diaphragm.

* * * * *

Disclaimer 3,984,947.—*Francis Joseph Patry,* Lewiston, Me. ROOF STRUCTURE INCLUDING A ONE-WAY VAPOR VENT. Patent dated Oct. 12, 1976. Disclaimer filed Apr. 20, 1983, by the assignee, *Johns-Manville Corp.*

Hereby enters this disclaimer to claims 1-4 of said patent.

[*Official Gazette June 7, 1983.*]